United States Patent [19]

Coffenberry

[11] Patent Number: 4,930,459

[45] Date of Patent: Jun. 5, 1990

[54] FREEZE PLUG

[75] Inventor: Norman D. Coffenberry, Washington Court House, Ohio

[73] Assignee: SDI Operating Partners, L.P., Del.

[21] Appl. No.: 383,866

[22] Filed: Jul. 21, 1989

[51] Int. Cl.[5] ..... F01P 5/14

[52] U.S. Cl. ..... 123/41.15; 123/41.5; 138/89; 220/201; 220/352; 29/525

[58] Field of Search ..... 123/41.15, 41.5, 198 D; 138/89; 137/62, 79, 468; 251/297; 220/1 V, 201, 352; 29/525

[56] References Cited

U.S. PATENT DOCUMENTS

| | | | |
|---|---|---|---|
| 397,839 | 2/1889 | Dodge | 220/352 |
| 787,460 | 4/1905 | Mosher | 220/352 |
| 1,492,248 | 4/1924 | Hachmann | 220/284 |
| 1,710,363 | 4/1929 | Kramer | 220/352 |
| 1,888,319 | 11/1932 | Hopkins | 220/352 |
| 3,333,723 | 8/1967 | Wisman | 220/235 |
| 3,889,841 | 6/1975 | Edmonds | 123/41.15 |
| 4,750,457 | 6/1988 | Bonutti | 123/41.15 |

*Primary Examiner*—Noah P. Kamen

*Attorney, Agent, or Firm*—Wood, Herron & Evans

[57] ABSTRACT

A cup-shaped freeze plug for a coolant hole in an engine block. The plug includes a base section having a diameter less than the hole's nominal diameter, the base diameter being sized to permit the plug to be hand-fitted into the coolant hole at an intermediate non-sealing position. The plug also includes a rim section formed integral with the base section, the rim section having a diameter greater than the hole's nominal diameter, the rim diameter being sized to allow the plug to be force-fitted into the coolant hole at a final coolant sealing position.

5 Claims, 1 Drawing Sheet

FREEZE PLUG

This invention relates to freeze plugs. More particularly, this invention relates to freeze plugs of the type adapted to be used with engine blocks.

A cup-shaped freeze plug is often used with an engine block of a liquid cooled internal combustion engine. This is particularly true of those engines used in over-the-road motor vehicles, e.g., automobiles, trucks and buses. The freeze plug operates to stop up a hole in the engine block which opens into the block's coolant channel. The objective of the freeze plug is to protect the engine block, i.e., to keep the engine block from cracking, in the event the liquid coolant freezes in cold weather. Specifically, and when the system operates correctly, the freeze plug functions to pop out of the engine block's hole, instead of the engine block cracking, when the liquid coolant in the engine expands upon freezing. The freeze plug functions in this manner because the plug itself is sized and fitted into the engine block's hole so it takes less coolant expansion pressure to pop the plug out than to crack the block.

There is one problem of significance with cup-shaped freeze plugs which I am familiar with, and that are commercially used today. The freeze plug is press-fitted in the engine block's hole to provide a non-leaking friction fit seal. This press fit obviously must be a very tight friction fit since in use the freeze plug prevents coolant from exhausting out of the engine block's hole, and since the objective is to have the plug pop out so as to prevent the block from cracking if the coolant within the block freezes. Now with prior art freeze plugs of which I am aware, and which are of the cup-shaped type, the prior art plug tends to roll around in the engine block's bore as an effort is made to drive it into its final press-fit sealing position within the bore. In other words, when a mechanic tries to drive the separate cup-shaped freeze plug into the engine block's bore with a punch or hammer, it is difficult to get the plug started in straight in the first place. And if the freeze plug is not put in straight, or if its side walls are nicked or gouged as it is put in, then in the second place liquid coolant tends to leak out of the engine's block bore as the engine is used. Quite obviously, coolant leakage from an engine block's coolant system is undesirable.

Therefor, it has been the objective of this invention to provide an improved cup-shaped freeze plug for a coolant hole in an engine block where the freeze plug can be preliminarily set into an intermediate position within the block's hole by hand, and where thereafter the freeze plug can be driven into tight fitting sealed relation with the bore by a mechanic, thereby minimizing the use difficulties with prior art freeze plugs as discussed above.

In accord with this objective, this invention contemplates a cup-shaped freeze plug for a coolant hole in an engine block. The plug includes a base section having a diameter less than the hole's nominal diameter, the base diameter being sized to permit the plug to be hand-fitted into the coolant hole at an intermediate non-sealing position. The plug also includes a rim section formed integral with the base section, the rim section having a diameter greater than the hole's nominal diameter, the rim diameter being sized to allow the plug to be force-fitted into the coolant hole at a final coolant sealing position.

Other objectives and advantages of the invention will be more apparent from the following detailed description taken in conjunction with the drawings in which.

Figure 1:
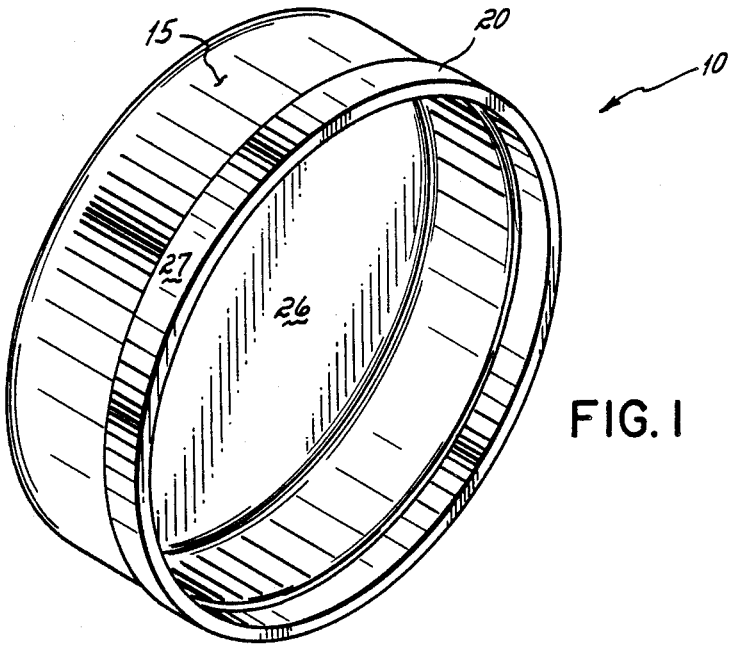
FIG. 1 is a perspective view of a cup-shaped freeze plug in accord with the principles of this invention.

The freeze plug 10 in accord with the principles of this invention is a cup-shaped type freeze plug that is circular in cross-section as shown in FIG. 1. The freeze plug 10 is adapted for use in a circular cross-sectional coolant hole 11 in an engine block 12. The coolant hole 11 has a nominal diameter 13.

Figure 2:
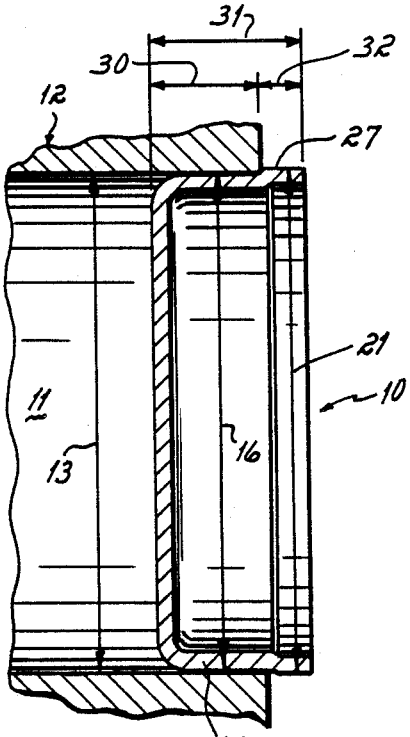
FIG. 2 is a cross-sectional view illustrating an intermediate assembly step of the freeze plug with an engine block's hole.

The cup-shaped freeze plug 10 basically includes a base section 15 having an outside diameter 16 less than the nominal diameter 13. The base diameter 16 is sized to permit the plug 10 to be hand-fitted into the coolant hole 11 at an intermediate non-sealing position as shown in FIG. 2. In other words, the outside diameter 16 of the plug's base section 15 is sized so that no tools are required to fit the freeze plug into the engine block's coolant hole at that position shown in FIG. 2.

Figure 3:
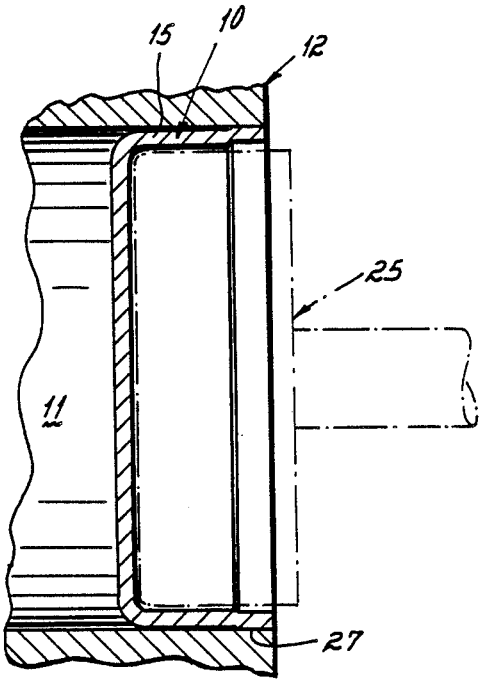
FIG. 3 is a view similar to FIG. 2 illustrating the final sealing position of the freeze plug with the engine block's bore.

The freeze plug 10 also includes a rim section 20 formed integral with the base section 15. The rim section has an outside diameter 21 greater than the nominal diameter 13. The rim diameter 21 is sized to allow the plug 10 to be force fitted into the coolant hole 11 at a final coolant sealing position as shown in FIG. 3. It is necessary that hand or power tools be used to translate the freeze plug 10 from the FIG. 2 intermediate non-sealing position into the FIG. 3 final coolant sealing position. For example, a punch 25 and hammer (not shown) can be used, the punch being sized to fit inside the cup-shaped freeze plug 10 against its floor 26, and the hammer being used to drive the plug 10 into place, all as shown in FIG. 3.

It is preferred that the freeze plug's base diameter 16 be between about 0.2% and about 0.8% less than the engine block coolant hole's nominal diameter 13. This will ensure that the freeze plug 10 can be easily hand-fitted into the engine block's coolant hole from exterior thereof until the FIG. 2 intermediate position is achieved. It is also preferred that the freeze plug's rim diameter 21 be between about 0.7% and about 0.9% greater than the engine block coolant hole's nominal diameter. It has been found that this rim diameter 21 allows a goods friction fit seal to be achieved between the freeze plug 10 and the engine block 12 when the freeze plug is in the sealing position shown in FIG. 3. It is further preferred that the freeze plug's base section 15 have a depth 30 of between about 50% and about 70% of the overall depth 31 of the freeze plug 10. And it has been found that the freeze plug's rim section 20 is preferably of a depth 32 of between about 30% and about 50% of the overall depth 31 of the freeze plug 10. The depth 30-32 relationships of the freeze plug's base section 15 and rim section 20, in combination with the diameter 16, 21 relationships between the freeze plug's base section and rim section vis-a-vis the hole's nominal diameter 13, have unexpectedly been found to provide a freeze plug 10 which can be easily hand-fitted in an intermediate assembly position within an engine block's coolant hole 11, see FIG. 2, while providing a complete friction-fitted seal for the hole after the freeze plug is driven into final sealing position, see FIG. 3. This very simple freeze plug 10 structure solves a long outstanding problem in that it practically ensures that the freeze plug will be put in straight in the block's hole 11, and that the friction fit outside side wall surface 27 of the plug's rim section 20 will not be unduly nicked or gouged as it is put in.

A freeze plug 10 in accord with the principles of this invention, when it is metal freeze plug, is manufactured by a series of steps. First, a blanking step is used in which a flat plug blank (not shown) is stamped out of a metal sheet. When the engine block's coolant hole 11 is circular in cross-section as in the embodiment illustrated in this application, the flat plug blank is formed simply by stamping out a flat round metal piece. Second, the metal blank stamped out is then formed into the cup-shaped configuration of the freeze plug illustrated in FIG. 1. This forming step requires use of a male mandrel and a female die, the male mandrel being relieved at its tip to allow undersizing of the freeze plug's base section 15. Specifically, the male mandrel cooperates with a female die through which the flat plug blank is drawn. As the plug blank is drawn through the female die by the male mandrel, the blank is sized to establish the freeze plug's major diameter rim section 20 by virtue of the female die, and is sized to establish the minor diameter base section 16 due to the relief configuration on the mandrel's tip.

Having described in detail the preferred embodiment of my invention, what I desire to claim and protect by Letters Patent is:

1. A method of installing a freeze plug in a coolant hole for an engine block, said method comprising the steps of providing a cup-shaped freeze plug having a base section of a minor outside diameter which is less than the nominal diameter of said hole, and a rim section of a major outside diameter which is greater than the nominal diameter of said hole, preliminarily fitting said freeze plug's base section into said hole by hand in a non-sealing position in order to properly orient and locate said freeze plug in said hole, and thereafter force fitting said freeze plug's rim section into said hole by driving said rim section into a coolant sealing position therein.

2. A method as set forth in claim 1, said cup-shaped freeze plug having a base diameter between about 0.2% and about 0.8% less than said nominal diameter, and said rim section having a rim diameter of between about 0.7% and about 0.9% greater than said nominal diameter.

3. A method as set forth in claim 2, said base section having a depth of between about 50% and about 70% of the overall depth of said plug, and said rim section having a depth of between about 30% and about 50% of the overall depth of said plug.

4. An engine block assembly for use in a motor vehicle, said assembly comprising an engine block having a coolant hole, said hole having a nominal diameter, and a freeze plug sealingly fitted in said coolant hole, said plug comprising a base section having an outside diameter less than said nominal diameter, said base diameter being sized to permit said plug to be hand-fitted into said coolant hole at an intermediate non-sealing position, and a rim section formed integral with said base section, said rim section having an outside diameter greater than said nominal diameter, said rim diameter being sized to allow said plug to be force-fitted into said coolant hole at a final coolant sealing position.

5. An assembly as set forth in claim 4, said base diameter being between about 0.2% and about 0.8% less than said nominal diameter, and said base section having a depth of between about 50% and about 70% of the overall depth of said plug, and said rim diameter being between about 0.7% and about 0.9% greater than said nominal diameter, and said rim section having a depth of between about 30% and about 50% of the overall depth of said plug.

* * * * *